US006188166B1

(12) United States Patent
Nishikawa et al.

(10) Patent No.: US 6,188,166 B1
(45) **Date of Patent: *Feb. 13, 2001**

(54) SPARK PLUG HAVING A METAL LAYER IN A TERMINAL METAL PIECE

(75) Inventors: Kenichi Nishikawa, Aichi (JP); Yutaka Tanaka, Irvine, CA (US)

(73) Assignee: NGK Spark Plug Co., Ltd., Nagoya (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/316,008

(22) Filed: May 21, 1999

(30) Foreign Application Priority Data

May 26, 1998 (JP) ..... 10-144596

(51) Int. Cl.[7] ..... H01T 13/20
(52) U.S. Cl. ..... 313/141; 313/144; 313/145
(58) Field of Search ..... 313/140, 141, 313/143, 144, 145; 123/169 EL

(56) References Cited

U.S. PATENT DOCUMENTS 3,525,894 * 8/1970 Blum et al. ..... 313/144
3,562,187 * 2/1971 Abdella et al. ..... 313/144
3,909,459 9/1975 Friese et al. ..... 252/509
4,893,051 * 1/1990 Kondo ..... 313/141
5,838,094 * 11/1998 Hanspal ..... 313/141
5,952,769 * 9/1999 Budaragin ..... 313/141
5,962,957 * 10/1999 Tanaka et al. ..... 313/141

FOREIGN PATENT DOCUMENTS 0 933 848 8/1999 (EP) .

* cited by examiner

*Primary Examiner*—Michael H. Day
*Assistant Examiner*—Mariceli Santiago
(74) *Attorney, Agent, or Firm*—Finnegan, Henderson, Farabow, Garrett & Dunner, L.L.P.

(57) ABSTRACT

A resistor spark plug includes an insulator having an axially extending through-hole. A center electrode is disposed within the through-hole of the insulator such that the center electrode projects from a tip end of the insulator. A terminal metal piece is disposed within the through-hole of the insulator such that the terminal metal piece projects from a tail end of the insulator. A conductive coupling layer is disposed within the through-hole and located between the center electrode and the terminal metal piece. The conductive coupling layer comprises a conductive glass seal layer formed on at least an end facing the terminal metal piece. A surface layer region of the terminal metal piece that comes into contact with the conductive glass seal layer is formed mainly of one or more metals selected from the group consisting of Zn, Sn, Pb, Rh, Pd, Pt, Cu, Au, Sb, and Ag.

14 Claims, 6 Drawing Sheets

SPARK PLUG HAVING A METAL LAYER IN A TERMINAL METAL PIECE

BACKGROUND OF THE INVENTION

1. Field of the Invention

The present invention relates to a spark plug used in an internal combustion engine, and more particularly to a resistor spark plug including a resistor for preventing generation of radio noise.

2. Description of the Related Art

An existing resistor spark plug has the following structure. A terminal metal piece is inserted into one end of an axially extending through-hole of an insulator and is fixed thereto. A center electrode is inserted into the through-hole from the other end and is fixed thereto. A resistor is disposed within the through-hole to be located between the terminal metal piece and the center electrode. The resistor is formed of a oil mixture of glass and a conductive material such as carbon black or metal. However, since the metal content of the resistor is not very high, in many cases, direct connection with the terminal metal piece or the center electrode is difficult to achieve. Therefore, in general, a conductive glass seal layer formed of a mixture of glass and a relatively large amount of metal is disposed between the resistor and the terminal metal piece and between the resistor and the center electrode in order to increase the bonding strength.

Such a resistor spark plug is manufactured as follows. After a center electrode is inserted into and fixed to a through-hole of an insulator, powder of conductive glass is charged into the through-hole. Subsequently, powder of resistor composition material is charged into the through-hole, and powder of conductive glass is again charged into the through-hole. Finally, a terminal metal piece is press-fitted into the through-hole from an end opposite the center electrode, to thereby obtain an assembled unit. Thus, within the through-hole of the insulator, a layer of conductive glass powder, a layer of resistor composition powder, and another layer of conductive glass powder are successively layered from the side of the center electrode. The assembled unit is placed in a heating furnace to be heated to a temperature above the melting point of glass. Subsequently, the terminal metal piece is pushed toward the center electrode to compress the respective layers, so that the layers become a conductive glass seal layer on the center electrode side, a resistor, and a conductive glass seal layer on the terminal metal piece side. Thus is completed a structure in which the terminal metal piece and the center electrode are connected to the resistor via the respective conductive glass seal layers.

When a resistor spark plug is manufactured in the above-described manner, during the heating/compressing step, a tip end portion of the terminal metal piece is pushed into a layer of conductive glass powder that has been softened through heating, and finally the terminal metal piece is joined to the conductive glass seal layer in a state in which the tip end portion of the terminal metal piece is located in the conductive glass seal layer. In order to obtain a strong joint, it is important that the clearance between the outer circumferential surface of the tip end portion of the terminal metal piece and the inner surface of the through-hole of the insulator is sufficiently filled with the conductive glass seal layer. However, since the clearance is generally small, and the viscosity of softened conductive glass is not very high, the charge of glass is frequently insufficient. In this case, the bonding or bonding strength between the terminal metal piece and the conductive glass seal layer is insufficient, with a resultant possibility of the terminal metal piece coming off upon receipt of an impact. Further, the bonding strength between the terminal metal piece and the conductive glass seal layer easily deteriorates upon repeated application of high voltage to the spark plug.

In order to increase the bonding strength between the terminal metal piece and the conductive glass seal layer to thereby solve the above-described problem, in a generally used spark plug, a thread or knurl is formed on the outer circumferential surface of the tip end of the terminal metal piece, which is to be inserted into the conductive glass seal layer, to thereby increase the bonding strength between the terminal metal piece and the conductive glass seal layer by means of an anchor effect. However, when such a thread or knurl is formed on the outer circumferential surface of the tip end of the terminal metal piece, the charging of conductive glass into the clearance between the terminal metal piece and the insulator becomes more difficult, so that in some cases, the bonding strength, rather than being increased, is decreased.

SUMMARY OF THE INVENTION

An object of the present invention is to provide a spark plug having a structure which increases the bonding strength between a conductive glass seal layer and a terminal metal piece to thereby prevent occurrence of failures such as coming off a terminal metal piece and deterioration in the bonding strength between the terminal metal piece and the conductive glass seal layer.

To achieve the above object, according to a first aspect of the present invention, there is provided a spark plug comprising a metallic shell having a ground electrode, an insulator disposed within the metallic shell and having an axially extending through-hole, a center electrode disposed within the through-hole of the insulator, a terminal metal piece disposed within the through-hole of the insulator, and a conductive coupling layer disposed within the through-hole and located between the center electrode and the terminal metal piece.

The conductive coupling layer comprises a conductive glass seal layer formed at least on a side in contact with the terminal metal piece. A surface layer region of the terminal metal piece that comes into contact with the conductive glass seal layer is formed of a metal layer mainly made of at least one metal selected from the group consisting of Zn, Sn, Pb, Rh, Pd, Pt, Cu, Au, Sb, and Ag. In the present specification, the name of each element is represented by its symbol.

In the spark plug according to the present invention, since a metal layer of the above-described material is formed on the surface of the terminal metal piece that comes into contact with the conductive glass seal layer, the bonding strength between the terminal metal piece and the conductive glass seal layer is increased. As a result, it becomes possible to prevent problems such as coming off of the terminal metal piece, which would otherwise occur upon application of impact on the spark plug. Further, even when high voltage is repeatedly applied to the spark plug, the bonding strength between the terminal metal piece and the conductive glass seal layer hardly deteriorates. The reason why the bonding strength can be increased through formation of the metal layer is conceivably that the wettability of the terminal metal piece with respect to the glass material portion within the conductive glass seal layer is improved through formation of the metal layer.

The metal content of the conductive glass seal layer may be set to 35 to 70 wt. %. Specifically, the conductive glass seal layer may contain at least either Cu or Fe as a main component. When the metal content is less than 35 wt. %, the conductivity of the layer is poor with a resultant possibility that electrical connection cannot be attained between the terminal metal piece and the conductive glass seal layer. In contrast, when the metal content is in excess of 70 wt. %, the sealing performance may become poor.

The metal layer may be formed through chemical plating such as electroplating or electroless plating. Alternatively, the metal layer may be formed through vapor phase deposition such as vacuum deposition, ion plating, or sputtering.

The metal layer preferably has a thickness of 0.1 μm or greater. When the thickness is less than 0.1 μm, in some cases the effect of the metal layer in increasing the bonding strength between the terminal metal piece and the conductive glass seal layer cannot be obtained. More preferably, the metal layer has a thickness of 1 μm or greater. When the thickness of the metal layer is in excess of 50 μm, the effect of increasing the bonding strength attained by the increased layer thickness becomes insignificant, and cost increases wastefully. Therefore, the thickness of the metal layer is preferably set to not greater than 50 μm.

According to a second aspect of the present invention, there is provided a spark plug comprising a metallic shell having a ground electrode, an insulator disposed within the metallic shell and having an axially extending through-hole, a center electrode disposed within the through-hole of the insulator, a terminal metal piece disposed within the through-hole of the insulator, and a conductive coupling layer disposed within the through-hole to be located between the center electrode and the terminal metal piece, wherein the conductive coupling layer comprises a conductive glass seal layer formed at least on a side in contact with the terminal metal piece, and a surface layer region of the terminal metal piece that comes into contact with the conductive glass seal layer is formed of a conductive or semi-conductive oxide layer and has a thickness of 0.1 μm or greater.

In this spark plug, as in the spark plug according to the first aspect, the bonding strength between the terminal metal piece and the conductive glass seal layer is increased. As a result, it becomes possible to prevent problems such as coming off of the terminal metal piece, which would otherwise occur due to receipt of impact. Further, even when high voltage is repeatedly applied to the spark plug, the bonding strength between the terminal metal piece and the conductive glass seal layer hardly deteriorates. The reason why the bonding strength can be increased through formation of the oxide layer is conceivably that the wettability of the terminal metal piece with respect to the glass material portion within the conductive glass seal layer is improved through formation of the oxide layer. Moreover, since the oxide layer is conductive or semi-conductive, electrical connection between the terminal metal piece and the metal within the conductive glass seal layer can be attained with ease.

When the thickness of the oxide layer is less than 0.1 μm, in some cases the effect of the oxide layer in increasing the bonding strength between the terminal metal piece and the conductive glass seal layer cannot be obtained sufficiently. More preferably, the oxide layer has a thickness of 1 μm or greater.

The oxide layer may be a layer of an Ni-containing oxide. The term "Ni-containing oxide" refers to an oxide whose main metal-element component is Ni; e.g., NiO. Since NiO is semi-conductive, a layer of an oxide containing NiO as a main component has a relatively high conductivity and excellent wettability with respect to the glass component of the conductive glass seal layer. Therefore, the Ni-containing oxide layer is advantageously used in the present invention.

The terminal metal piece may have a structure in which the surface of a core made of low carbon steel or other suitable material is coated with an Ni-containing metal layer mainly formed of Ni. The Ni-containing metal layer may be an Ni plated layer formed through electroplating or any other suitable method. When the above-described metal layer is formed, a terminal metal piece made of Ni or an Ni alloy is preferably used in the present invention, because excellent close contact is established between the terminal metal piece and the metal layer. Meanwhile, when the Ni-containing oxide layer is formed from an Ni-containing metal layer, it can be formed easily through proper oxidation treatment of the Ni-containing metal layer.

Specifically, the Ni-containing oxide layer can be formed by one the following methods: a method in which a terminal metal piece having an Ni-containing metal layer is held at a high temperature (e.g., 700° C. or higher) in an oxygen-containing atmosphere such as air in order to oxidize the surface of the Ni-containing metal layer; a method in which the surface of an Ni-containing metal layer is brought into contact with water vapor of high temperature (e.g., 700° C. or higher); and an anodic oxidation method. Also, there may be employed a method in which the surface of an Ni-containing metal layer is brought into contact with any of various kinds of oxidizing agents. Examples of such oxidizing agents include halogen gases such as chlorine gas and bromine gas, liquid into which a halogen gas is dissolved; acids such as nitric acid, hydrochloric acid, or chlorine-containing oxo acid (e.g., chloric acid or perchloric acid), and their aqueous solutions; chromic acid, bichromic acid, or aqueous solutions of their salts; permanganic acid or aqueous solution of its salts; and hydrogen peroxide. Two or more of the above-described methods may be used in combination.

In addition to the above-described oxidation treatment, the oxide layer used in the present invention, including the above-described Ni-containing oxide film, may be formed by radio frequency sputtering, reactive sputtering, vapor-phase deposition such as CVD, or a sol-gel method in which hydrated oxide so is prepared through, for example, hydrolysis of metal alkoxide, applied to the terminal metal piece, and heated after drying to obtain an oxide coating. By use of these methods, there can be formed a layer of any of various kinds of conductive and semi-conductive oxides such as indium oxide ($In_2O_3$), tin oxide ($SnO_2$), chromium oxide ($Cr_2O_3$, $CrO_2$), vanadium oxide ($V_2O_3$, $VO_2$), or titanium oxide ($TiO_2$).

According to a third aspect of the present invention, there is provided a spark plug comprising a metallic shell having a ground electrode, an insulator disposed within the metallic shell and having an axially extending through-hole, a center electrode disposed within the through-hole of the insulator, a terminal metal piece disposed within the through-hole of the insulator, and a conductive coupling layer disposed within the through-hole to be located between the center electrode and the terminal metal piece, wherein the conductive coupling layer comprises a conductive glass seal layer formed at least on a side in contact with the terminal metal piece, and the conductive glass seal layer is formed of a mixture of a metal and glass, and contains, as an auxiliary metal component, at least one metal selected from Zn, Sb, Sn, Ag, and Ni in an amount of 0.1 to 10 wt. %.

Since the conductive glass seal layer contains the auxiliary metal component in an amount of the above-described range, the bonding strength between the terminal metal piece and the conductive glass seal layer is increased, to thereby decrease the possibility of occurrence of a failure such as coming off of the terminal metal piece which may occur upon application of impact on the spark plug. The auxiliary metal(s) is preferably incorporated in a total amount of 2 to 7 wt. %.

The reason why the above-described structure improves the bonding strength between the terminal metal piece and the conductive glass seal layer is presumed to be as follows. The conductive glass seal layer is formed by, for example, a method in which a mixed powder containing glass powder, which forms a glass material portion, and a metal powder, which is to form a metallic portion, is fired integrally with the terminal metal piece, by use of a hot press method (example temperature: 800 to 1000° C.). At this time, metal powder containing the above-described auxiliary metal component is mixed as the metal powder. If the auxiliary metal component is Zn, Sb, Sn, or any other metal having a relatively low melting point, at least part of the auxiliary metal component melts during firing, so that liquid phase is generated, with resultant formation of a new metal layer between the conductive glass seal layer and the terminal metal piece. As a result, the bonding strength between the conductive glass seal layer and the terminal metal piece is conceivably improved. Although Ag and Ni have relatively high melting points, these components are conceivably dispersed to the side of the surface layer portion of the terminal metal piece, leading to improvement in tight bonding.

In this case, the structures of the above-described spark plugs according to the first and second aspects, wherein a metal layer or an oxide layer is formed on the terminal metal piece, may be combined in order to further increase the bonding strength between the terminal metal piece and the conductive glass seal layer.

When the total content of the auxiliary metal component within the conductive glass seal layer is less than 0.1 wt. %, the effect of improving bonding strength through addition of the component is insignificant. Meanwhile, when the total content of the auxiliary metal component is in excess of 10 wt. %, the sealing performance may be deteriorated. The total content is preferably set to 2 to 7 wt. %.

When Ni is added as the auxiliary metal component, Ni may be mixed in the form of powder of Ni-containing brazing filler containing at least one material selected from Cr, B, Si, C, Fe, and P. In this case, an Ni-based metal phase containing Ni as a main component and further containing at least one element selected from Cr, B, Si, C, Fe, and P may be formed. Such an Ni-containing brazing filler has a melting point lower than that of elemental Ni. When an Ni-containing brazing filler having a solidus line temperature near the above-described firing temperature (800 to 1000° C.), the bonding strength between the terminal metal piece and the conductive glass seal layer can be further improved.

The Ni-containing brazing filler may contain Ni as a main component and at least one element selected from Cr (5 to 21 wt. %), B (2.5 to 4 wt. %), Si (3 to 11 wt. %), C (not greater than 0.15 wt. %), Fe (1 to 5 wt. %), and P (9 to 13 wt. %).

In the respective structures of the spark plug of the present invention, the bonding strength between the conductive glass seal layer and the terminal metal piece can be increased remarkably. For example, in the structure in which the tip end of the terminal metal piece is brought into contact with the conductive glass seal layer while being inserted therein, the bonding strength between the conductive glass seal layer and the terminal metal piece can be secured sufficiently even when the tip end has a substantially smooth outer circumferential surface (which may have unevenness on a micro scale). This eliminates necessity of formation of a thread or knurl on the outer circumferential surface of the tip end of the terminal metal piece, which has been practiced in the manufacture of conventional spark plugs, to thereby simplify the production process. Further, since the smooth outer circumferential surface of the tip end enables smooth charging of conductive glass into the clearance between the tip end and the inner surface of the insulator, excellent bonding strength can be obtained.

Through formation of a thread or knurl, projections and depressions may be formed on the outer circumferential surface of the tip end of the terminal metal piece in order to establish meshing engagement between the terminal metal piece and the conductive glass seal layer. The formation of projections and depressions further increases the bonding strength between the terminal metal piece and the conductive glass seal layer.

Additional objects and advantages of the invention will be set forth in part in the description which follows, and in part will be obvious from the description, or may be learned by practice of the invention. The advantages and purpose of the invention will be realized and attained by the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

Various other objects, features and many of the advantages of the present invention will be readily appreciated as the same becomes better understood by reference to the following detailed description of the preferred embodiments when considered in connection with the accompanying drawings, in which.

DESCRIPTION OF THE PREFERRED EMBODIMENTS

Reference will now be made in detail to the present preferred embodiments of the invention, examples of which are illustrated in the accompanying drawings. Wherever possible, the same reference numbers will be used throughout the drawings to refer to the same or like parts.

Figure 1:
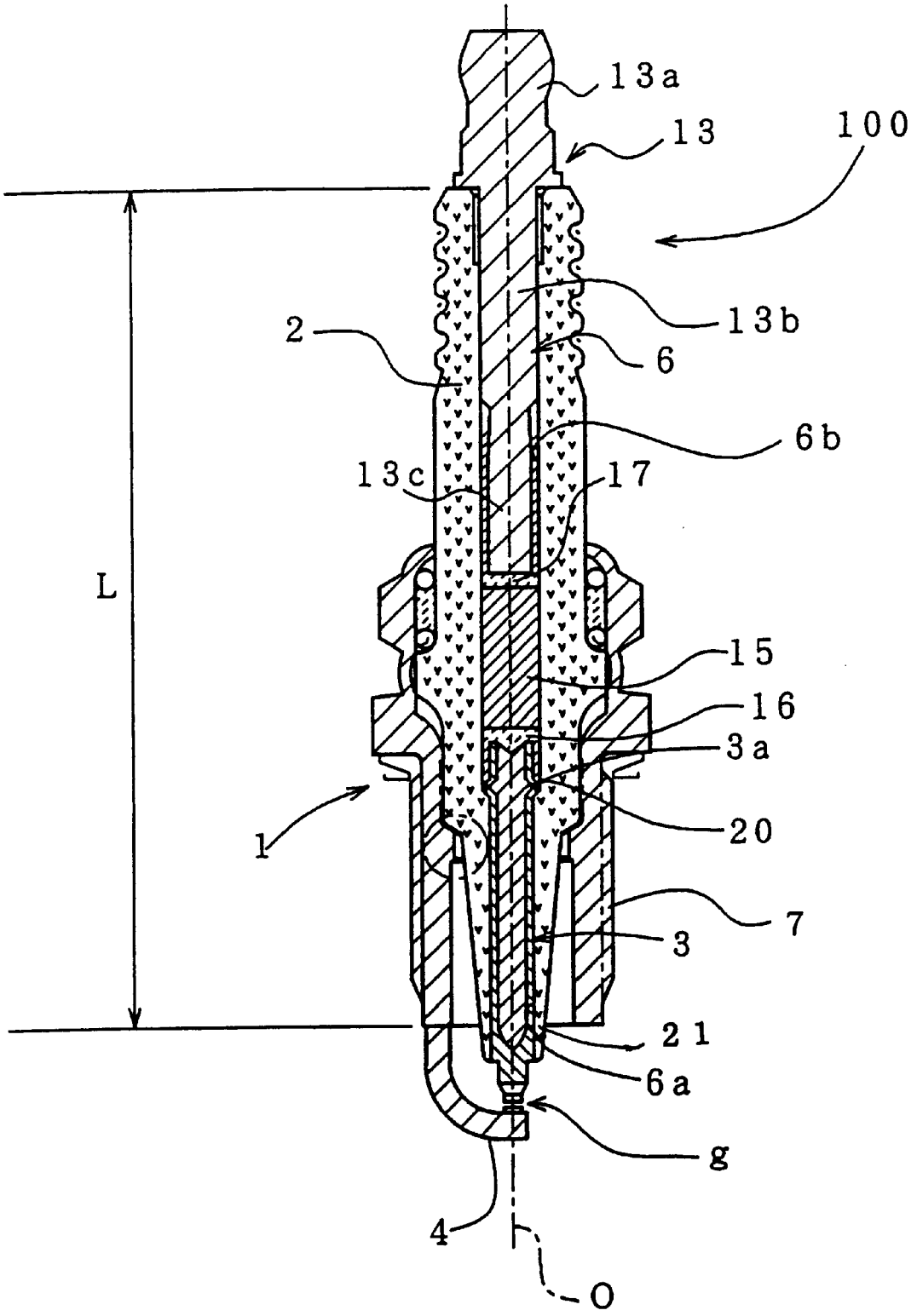
FIG. 1 is a longitudinal sectional view of a spark plug according to an embodiment of the present invention.

As shown in FIG. 1, a spark plug 100 according to an embodiment of the present invention comprises a cylindrical metallic shell 1, an insulator 2, a center electrode 3, and a ground electrode 4. The insulator 2 is fitted into the metallic shell 1 such that a tip portion 21 of the insulator 2 projects from the metallic shell 1. The center electrode 3 is disposed inside the insulator 2 such that a tip end portion of the center electrode 3 projects from the insulator 2. One end of the ground electrode 4 is connected to the metallic shell 1, while the other end portion of the ground electrode 4 is bent to face the tip end of the center electrode 3. A spark discharge gap g is formed between the ground electrode 4 and the center electrode 3. In the following description, with respect to the axial direction of the center electrode 3, the side where the spark discharge gap g is formed will be referred to as the "tip side" and the side opposite to the tip side will be referred to as the "tail side."

The metallic shell 1 is formed of carbon steel or any other suitable material, and, as shown in FIG. 1, a thread portion 7 for attachment to a cylinder head is formed on the outer circumferential surface of the metallic shell 1. The spark plug 100 is attached to a cylinder head of, for example, a gasoline engine (internal combustion engine) by use of the thread portion 7. When a high voltage is applied between the ground electrode 4 and the center electrode 3, spark discharge occurs at the spark discharge gap g. Thus, the spark plug 100 serves as an ignition source. The thread portion 7 has an outer diameter of, for example, 14 mm. Further, an example length L from the open end of the metallic shell 1 from which the center electrode 3 projects to the tail-side end of the insulator 2 is 60 mm. The center electrode 3 is formed of an Ni alloy such as Inconel (trademark). The insulator 2 is formed of a sintered body of alumina ceramics or the like.

In the spark plug 100, a through-hole 6 is axially formed in the insulator 2. A terminal metal piece 13 is inserted into the through-hole 6 and is fixedly located at the tail-side end thereof, whereas the center electrode 3 is inserted into the through-hole 6 and is fixedly located at the tip-side end thereof. A resistor 15 is disposed in the through-hole 6 to be located between the terminal metal piece 13 and the center electrode 3. The opposite ends of the resistor 15 are electrically connected to the center electrode 3 and the terminal metal piece 13 via conductive glass seal layers 16 and 17, respectively. The conductive glass seal layers 16 and 17 and the resistor 15 form a conductive coupling layer. There may be employed a structure in which the resistor 15 is omitted, and the terminal metal piece 13 and the center electrode 3 are joined together via a single conductive glass seal layer. Further, when the resistor 15 is provided, the conductive glass seal layer 16 between the resistor 15 and the center electrode 3 may be omitted.

The through-hole 6 formed in the insulator 2 includes a substantially cylindrical first portion 6*a* and a substantially cylindrical second portion 6*b*. The center electrode 3 is inserted through the first portion 6*a*. The second portion 6*b* is located on the tail side (on the upper side in FIG. 1) of the first portion 6*a* and has a diameter larger than that of the first portion 6*a*. The terminal metal piece 13 and the resistor 15 are accommodated within the second portion 6*b*, and the center electrode 3 is inserted through the first portion 6*a*. A circumferential projection 3*a* for fixing the electrode is projected outward from the outer circumferential surface of a tail end portion of the center electrode 3. A projection reception surface 20 for receiving the projection 3*a* of the center electrode 3 is provided between the first portion 6*a* and the second portion 6*b* of the through-hole 6. The projection reception surface 20 assumes the form of a tapered surface or a curved surface.

Figure 2:
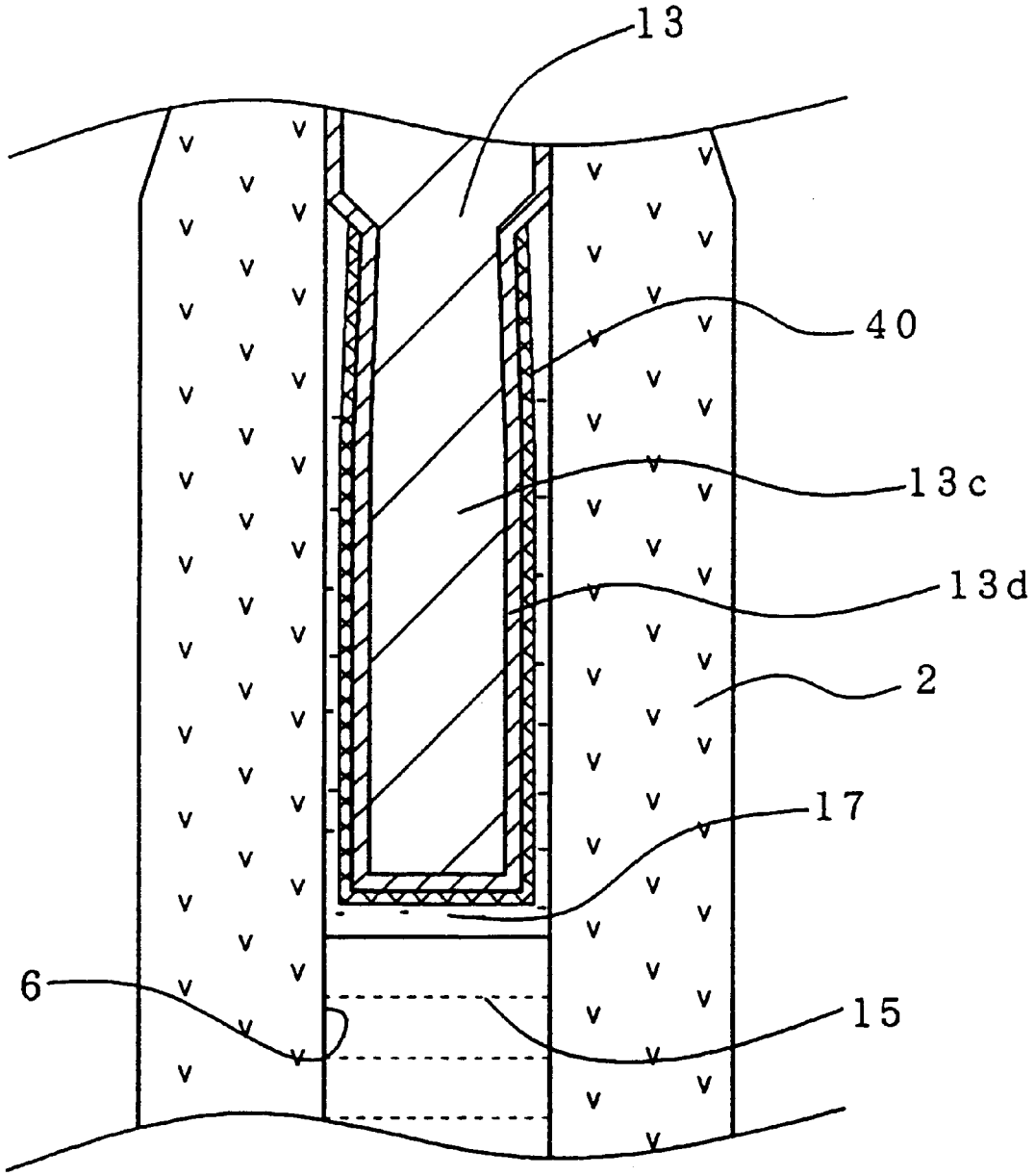
FIG. 2 is a partial sectional view of a main portion of the spark plug of FIG. 1.

The terminal metal piece 13 is formed of a low carbon steel, and an Ni layer (example thickness: 5 μm) 13*d* is plated on the surface of the terminal metal piece 13 for corrosion protection (see FIG. 2). The terminal metal piece 13 has a seal portion (tip end portion) 13*c*, a terminal portion 13*a* that projects from the tail-side end of the insulator 2, and a shaft portion 13*b* that connects the terminal portion 13*a* and the seal portion 13*c*. The seal portion 13*c* is formed into an axially elongated cylindrical shape, and the outer circumferential surface of the seal portion 13*c* is finished to have a smoothed surface. The seal portion 13*c* is disposed such that the greater portion of the seal portion 13*c* is inserted into the conductive glass seal layer 17, so that the conductive glass seal layer 17 provides sealing between the seal portion 13*c* and the inner surface of the through-hole 6. The clearance between the seal portion 13*c* and the inner surface of the through-hole 6 is about 0.1 to 0.5 mm.

Each of the conductive glass seal layers 16 and 17 is formed of glass which contains metal powder containing, as a main component, at least one metal such as Cu or Fe. The metal content of the conductive glass seal layer is set to 35 to 70 wt. %. Into the conductive glass seal layers 16 and 17, powder of a semi-conductive inorganic compound such as $TiO_2$ is mixed in a proper amount as needed.

As shown in FIG. 2, the surface (more specifically, the outer circumferential surface and the tip end surface) of the seal portion 13*c* of the terminal metal piece 13 is covered by a metal layer 40 such that the metal layer 40 covers the above-described plated Ni layer 13*d*. The metal layer 40 is mainly formed of at least one metal selected from Zn, Sn, Pb, Rh, Pd, Pt, Cu, Au, Sb, and Ag. The seal portion 13*c* is electrically connected with the conductive glass seal layer 17 via the metal layer 40. The metal layer 40 is formed by, for example, a chemical plating method such as electroplating or electroless plating. The thickness of the metal layer 40 is set to 0.1 μm or greater, preferably 1 μm or greater. In FIG. 2, the thicknesses of the plated Ni layer 13*d* and the metal layer 40 are represented in an exaggerated manner.

The resistor 15 is formed as follows. Glass powder, ceramic powder, metal powder (mainly formed of at least one metal selected from Zn, Sb, Sn, Ag, and Ni), powder of a nonmetallic conductive material (e.g., amorphous carbon, or graphite), an organic binder, etc. are mixed in proper ratios, and the resultant mixture is sintered by use of a hot press or a like apparatus.

Figures 3A, 3B, 3C, 3D:
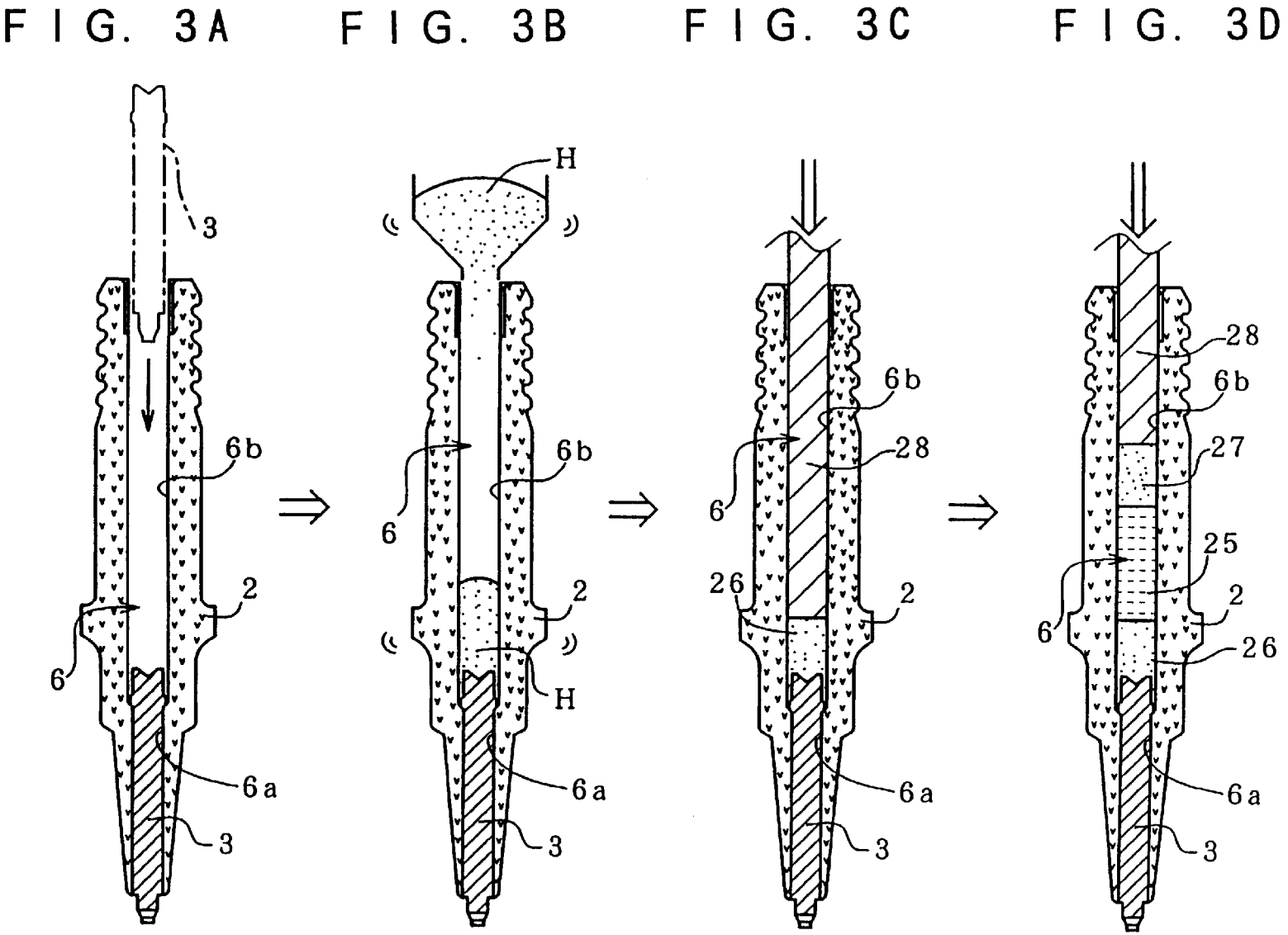
FIGS. 3A–3D are explanatory views showing the steps of a manufacturing process for the spark plug of FIG. 1.

In the resistor spark plug 100, assembly of the center electrode 3 and the terminal metal piece 13 into the insulator 2 and formation of the resistor 14 and the conductive glass seal layers 16 and 17 can be performed as follows. First, as shown in FIG. 3A, the center electrode 3 is inserted into the first portion 6*a* of the through-hole 6 of the insulator 2. Subsequently, as shown in FIG. 3B, conductive glass powder H is charged into the second portion 6*b*. The conductive glass powder H is a mixture of glass powder and metal powder, and the metal powder is mainly formed of at least one metal, such as Cu or Fe. The amount of the metal powder with respect to the total amount of the glass powder and the metal powder is set to 35 to 70 wt. %.

Subsequently, as shown in FIG. 3C, a press rod 28 is inserted into the second portion 6*b* in order to subject the powder H to preliminary compression to thereby form a conductive glass powder layer 26. Subsequently, material powder for the resistor is charged and subjected to preliminary compression. Further, conductive glass powder is charged and subjected to preliminary compression. Thus, as shown in FIG. 3D, within the second portion 6*b* of the through-hole 6, the conductive glass powder layer 26, a resistor material powder layer 25, and a conductive glass powder layer 27 are layered, in this sequence from the side of the center electrode 3 (from the lower side).

Figure 4A:
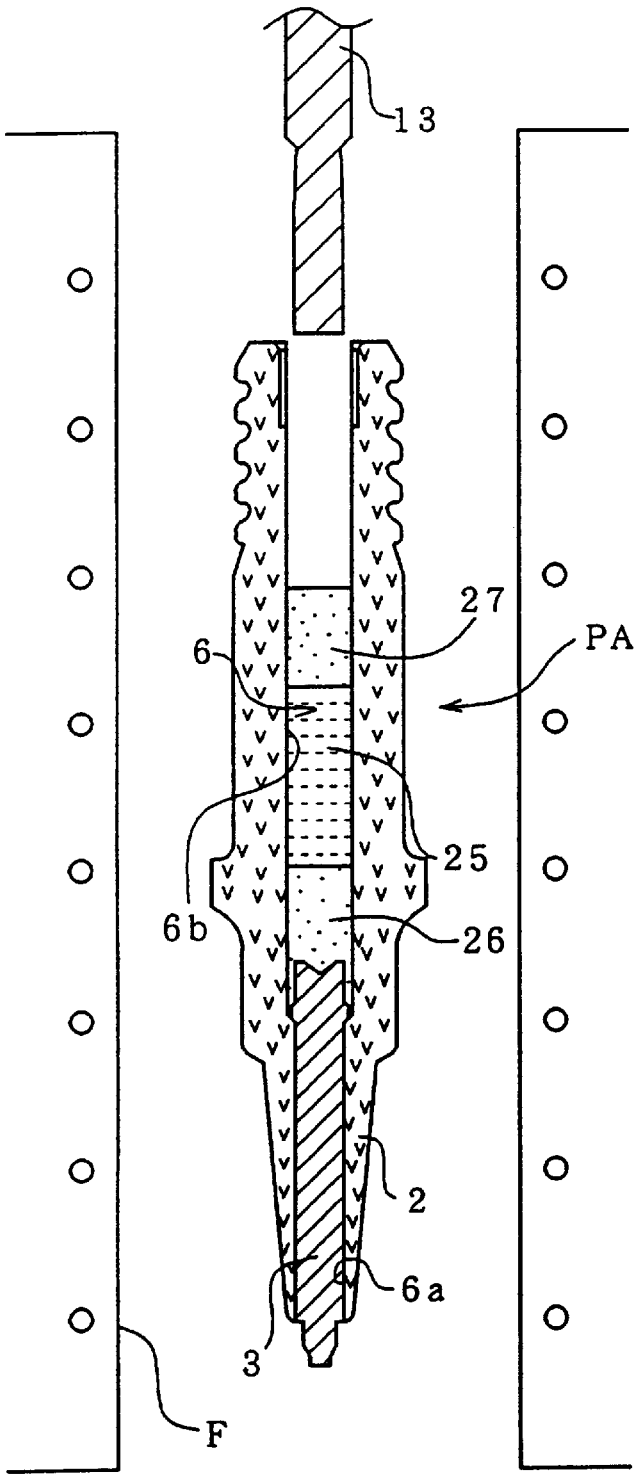
FIGS. 4A and 4B are explanatory views showing the steps subsequent to the steps shown in FIGS. 3A–3D.
Figure 4B:
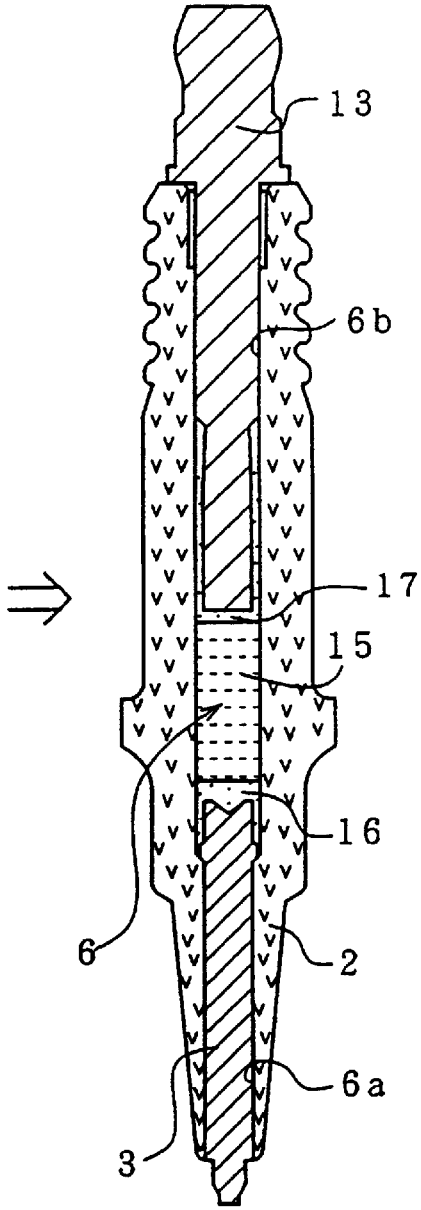

Subsequently, as shown in FIG. 4A, the entire assembly is inserted into a furnace F and heated to 800 to 1000° C., which is higher than the melting point of glass. Subsequently, the terminal metal piece 13 having the metal layer 40 on the seal portion 13*c* thereof is press-fitted into the through-hole 6 from the tail-side end opposite the center electrode 3 in order to axially press the layers 26, 25, and 27. In this way, hot press treatment is performed. As a result, as shown in FIG. 4B, the respective layers are compressed and sintered, so that a conductive glass seal layer 16, a resistor 15, and a conductive glass seal layer 17 are formed. At this time, the seal portion 13*c* is press-inserted into the softened conductive glass powder layer 27, so that the seal portion 13*c* is joined with the conductive glass seal layer 17 via the metal layer 40.

Since, as shown in FIG. 2, the metal layer 40 is formed on the surface of the seal portion 13*c* which comes into contact with the conductive glass seal layer 17, the bonding strength between the terminal metal piece 13 (seal portion 13*c*) and the conductive glass seal layer 17 is increased, so that the terminal metal piece 13 does not come off even upon receipt of impact. Further, even when high voltage is repeatedly applied to the spark plug 100, the bonding strength between the terminal metal piece 13 and the conductive glass seal layer 17 does not deteriorate.

Further, even when the outer circumferential surface of the seal portion 13*c* is finished to a smoothed surface, a sufficient bonding strength can be secured between the terminal metal piece 13 and the conductive glass seal layer 17. This eliminates necessity for formation of a thread or knurl on the seal portion 13*c* as in conventional spark plugs, so that the production process can be simplified. Moreover, since the smooth outer circumferential surface of the tip end enables smooth charging of conductive glass into the clearance between the wall surface of the through-hole 6 of the insulator and the peripheral surface of the seal portion 13*c*, air bubbles become unlikely to remain in the clearance, thus providing an advantageous effect in obtaining a desirable joint state.

Figure 5:
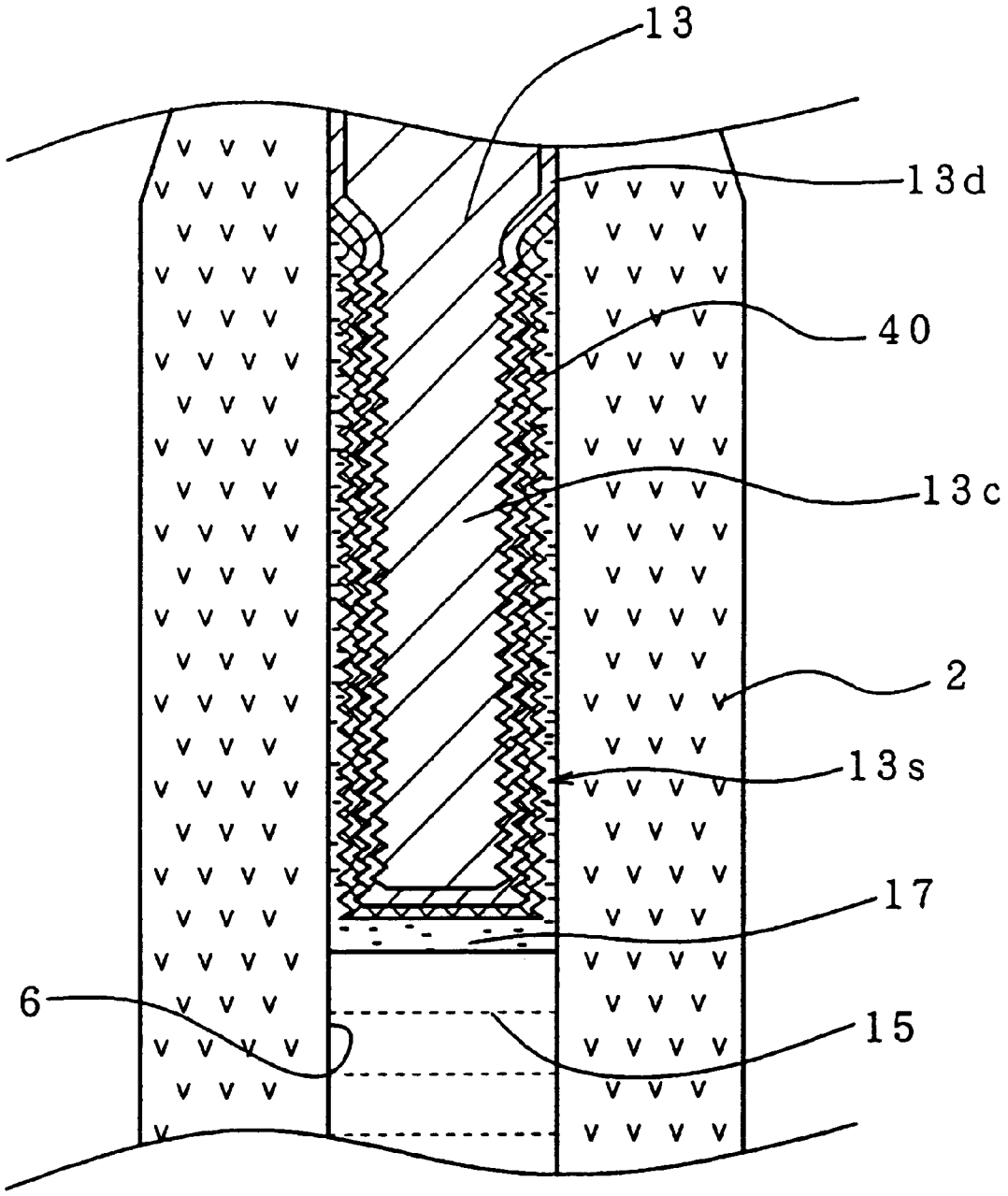
FIG. 5 is a partial sectional view of a main portion of a spark plug according to another embodiment of the present invention.

However, as shown in FIG. 5, as in conventional spark plugs, the seal portion 13*c* may be machined to have a thread portion 13*s* which serves as projections and depressions for establishing meshing engagement between the seal portion 13*c* and the conductive glass seal layer 17. In some cases, the formation of projections and depressions further increases the bonding strength between the terminal metal piece 13 and the conductive glass seal layer 17 by a so-called anchor effect. Further, instead of the thread portion 13*s*, knurls serving as projections and depressions may be formed (for example, a plurality of grooves extending along the axis of the seal portion 13 may be formed at predetermined circumferential intervals).

Figure 6:
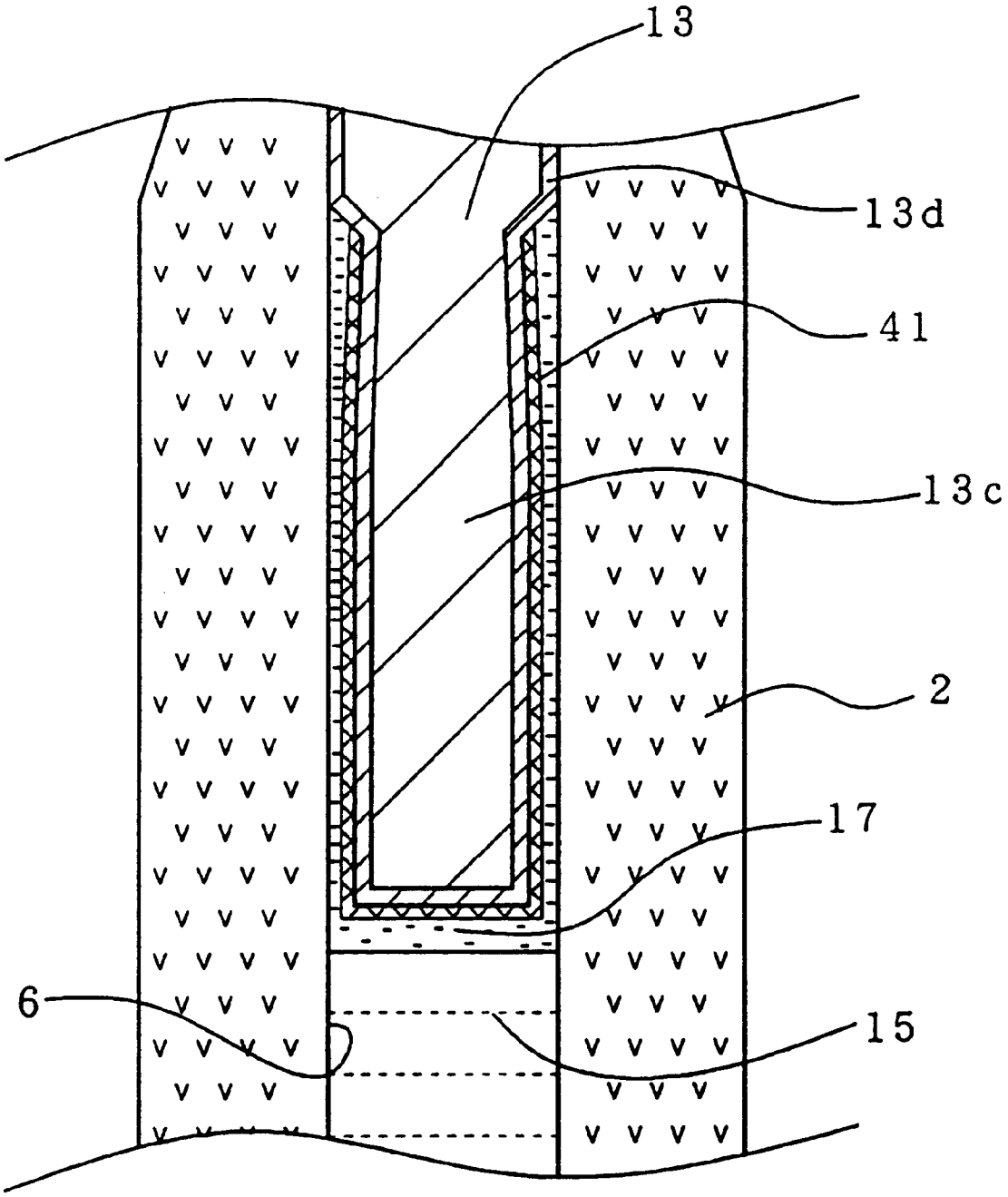
FIG. 6 is a partial sectional view of a main portion of a spark plug according to still another embodiment of the present invention.

In the spark plug 100 shown in FIG. 1, instead of the metal layer 40 shown in FIG. 2, an Ni-containing oxide layer 41 shown in FIG. 6 may be formed (in FIG. 6, the thicknesses of the plated Ni layer 13*d* and the Ni-containing oxide layer 41 are represented in an exaggerated manner). The Ni-containing oxide layer 41 is formed by one of the following methods: a method in which the surface of the plated Ni layer 13*d* of the seal portion 13*c* is oxidized in an oxygen-containing atmosphere (such as room air) at a high temperature of 700° C. or higher; a method in which the surface of the Plated Ni layer 13*d* is brought into contact with water vapor of high temperature (e.g., 700° C. or higher); a method in which the surface of the Plated Ni layer 13*d* is brought into contact with any of the above-described various oxidizing agents; and an anodic oxidation method. The thus-formed Ni-containing oxide layer 41 has a thickness of 0.1 μm or greater (preferably, 1 μm or greater).

Further, in the structures shown in FIGS. 2, 5, and 6, the conductive glass seal layer 17 may contain at least one auxiliary metal component selected from Zn, Sb, Sn, Ag, and Ni in an amount of 0.1 to 10 wt. % (preferably, 2 to 7 wt. %). Through addition of the auxiliary metal component, the bonding strength between the terminal metal piece 13 and the conductive glass seal layer 17 can be increased further. In this case, the metal layer 40 and the oxide layer 41 may be omitted from the seal portion 13*c* shown in FIGS. 2, 5, and 6.

EXAMPLE 1

Cu powder, Sn powder, and Fe powder (each having an average particle size of 30 μm) and glass powder (having an average particle size of 150 μm) were mixed such that the metal powder content became about 50 wt. %, to thereby prepare conductive glass powder. The material of the glass powder was borosilicate soda glass obtained through mixing and melting $SiO_2$ (60 wt. %), $B_2O_5$ (30 wt. %), $Na_2O$ (5 wt. %), and BaO (5 wt. %) and had a softening point of 750° C.

Meanwhile, resistor material powder was prepared as follows. Fine glass powder (30 wt. %, average particle size: 80 μm), $ZrO_2$ powder (60 wt. %, ceramic powder, average particle size: 3 μm), Al powder (1 wt. %, metal powder, average particle size: 20 to 50 μm), carbon black (6 wt. %, nonmetallic conductive material powder), and dextrin (3 wt. %, organic binder) were mixed, and then wet-mixed by use of a ball mill, while water was used as a solvent. Subsequently, the resultant mixture was dried to thereby prepare a preliminary material. Coarse glass powder (average particle size: 250 μm) was mixed thereto in an amount of 400 parts by weight with respect to 100 parts by weight of the preliminary material to thereby obtain resistor material powder. The material of the glass powder was borosilicate lithium glass obtained through mixing and melting $SiO_2$ (50 wt. %), $B_2O_5$ (29 wt. %), $Li_2O$ (4 wt. %), and BaO (17 wt. %) and had a softening point of 585° C.

Subsequently, various samples of the resistor spark plug 100 shown in FIG. 1 were produced by the method shown in FIGS. 3 and 4. The second portion 6*b* of the through-hole 6 of the insulator 2 had an inner diameter of 4.0 mm. The conductive glass powder was charged in an amount of 0.15 g in order to form the conductive glass powder layer 26. The resistor material powder was changed in an amount of 0.40 g. The conductive glass powder was again charged in an amount of 0.15 g in order to form the conductive glass powder layer 27. The hot press treatment was performed at a heating temperature of 900° C. and a pressure of 100 $kg/cm^2$.

The terminal metal piece 13 was made of a low carbon steel, and an Ni layer 13*d* having a film thickness of 5 μm was formed on the surface of the terminal metal piece 13 by electroplating. The seal portion 13*c* was formed into a circular columnar shape having an outer diameter of about 3.5 mm and a length of about 35 mm. The circumferential surface of the seal portion 13*c* was smoothed such that the surface roughness after the formation of the electroplated Ni layer 13*d* became about 6 μmRa (arithmetical mean deviation of profile). Further, the clearance between the wall surface of the through-hole 6 of the insulator 2 and the peripheral surface of the seal portion 13*c* was set to about 0.2 mm.

On the surface of the electroplated Ni layer 13*d* of the seal portion 13*c* of each sample, an Ni-containing oxide layer 41 (FIG. 6), or a metal layer 40 (FIG. 2) of Zn, Sn, Solder (Sn-10 wt. %Pb alloy), Rh, Pd, Pt, Cu, Au, Sb, or Ag was formed in one of various 1a thicknesses (Sample Nos. 1 to 28). The Ni-containing oxide layer was formed by a method in which the electroplated Ni layer 13*d* of the seal portion 13*c* was brought into contact with water vapor of 900° C. for 1 to 2 hours. The thickness of the Ni-containing oxide layer was measured through cross-section observation under a scanning electron microscope (SEM). The identification of the formed Ni-containing oxide layer through X-ray diffraction revealed that the Ni-containing oxide layer was mainly formed of Ni(ll) oxide (NiO). Further, the metal layer was formed through electroplating, and the thickness of the metal layer was measured by use of a fluorescent X-ray thickness meter or micrometer. The type of metal film/oxide film and the film thickness of each sample are shown in Table 1.

The center electrode 3 was formed of an Ni alloy (Inconel 600, general composition: Ni (75.8 wt. %), Cr (15.5 wt. %), Fe (8 wt. %), Mn (0.5 wt. %), Si (0.2 wt. %)). As Comparative Example 1, there was produced a spark plug in which neither a metal layer nor an Ni-containing oxide layer was formed on the seal portion 13*c* (Sample No. 29).

For the respective samples of the spark plugs, the bonding strength between the seal portion 13*c* and the conductive glass seal layer 17 was evaluated in the following manner. That is, an impact resistance test provided in JIS: B8031 was performed for 10 minutes and 30 minutes under the following conditions: amplitude of vibration was 22 mm, and impact frequency was 400 times/min. Variations in the resistance of the spark plug after the test were measured. When the bonding strength between the seal portion 13*c* and the conductive glass seal layer 17 is low, the resistance increases due to delamination caused by the impact. The evaluation was performed on the basis of the following criteria:

Excellent (A): the increase in resistance was not greater than 5%;

Good (B): the increase in resistance was 5 to 10%;

Moderate (C): the increase in resistance was 10 to 15%;

Poor (D): the increase in resistance was not less than 15%.

The evaluation of degree of sintering was performed as follows. The resistor was sliced into a predetermined shape, and its cross section was observed under an optical microscope (magnification: 20). When a considerable number of pores were formed in the resistor and water droplet was absorbed instantaneously, the resistor was evaluated as poor (X) in terms of degree of sintering. When substantially no pores were observed and the water droplet was not absorbed, the resistor was evaluated as good (O) in terms of degree of sintering. Table 1 shows the results of the evaluation.

TABLE 1

| | Surface treatment of terminals | Film thickness (μm) | Evaluation of impact resistance 10 min | Evaluation of impact resistance 30 min | Degree of sintering | Total |
|---|---|---|---|---|---|---|
| 1 | Oxide film coating | 0.05 | B | C | ○ | Δ |
| 2 | Oxide film coating | 0.1 | B | B | ○ | ○ |

TABLE 1-continued

| | Surface treatment of terminals | Film thickness (μm) | Evaluation of impact resistance 10 min | Evaluation of impact resistance 30 min | Degree of sintering | Total |
|---|---|---|---|---|---|---|
| 3 | Oxide film coating | 2 | A | A | ○ | ○ |
| 4 | Oxide film coating | 10 | A | A | ○ | ○ |
| 5 | Zn plating | 0.03 | B | C | ○ | Δ |
| 6 | Zn plating | 0.1 | B | B | ○ | ○ |
| 7 | Zn plating | 1 | A | A | ○ | ○ |
| 8 | Zn plating | 20 | A | B | ○ | ○ |
| 9 | Soldering (Pb) | 0.5 | A | B | ○ | ○ |
| 10 | Soldering (Pb) | 5 | A | A | ○ | ○ |
| 11 | Sn plating | 0.1 | B | B | ○ | ○ |
| 12 | Sn plating | 10 | A | A | ○ | ○ |
| 13 | Rh plating | 0.1 | B | B | ○ | ○ |
| 14 | Rh plating | 0.5 | A | B | ○ | ○ |
| 15 | Pd plating | 0.2 | B | B | ○ | ○ |
| 16 | Pd plating | 3 | A | A | ○ | ○ |
| 17 | Pt plating | 0.05 | B | C | ○ | Δ |
| 18 | Pt plating | 0.1 | B | B | ○ | ○ |
| 19 | Pt plating | 1 | B | B | ○ | ○ |
| 20 | Pt plating | 20 | A | B | ○ | ○ |
| 21 | Cu plating | 0.5 | B | B | ○ | ○ |
| 22 | Cu plating | 10 | A | A | ○ | ○ |
| 23 | Au plating | 0.1 | B | B | ○ | ○ |
| 24 | Au plating | 2 | A | A | ○ | ○ |
| 25 | Sb plating | 0.1 | B | B | ○ | ○ |
| 26 | Sb plating | 20 | A | B | ○ | ○ |
| 27 | Ag plating | 0.05 | B | C | ○ | Δ |
| 28 | Ag plating | 20 | A | B | ○ | ○ |
| 29* | None | — | B | D | ○ | X |

Note *outside the scope of the invention

As can be seen from Table 1, the spark plugs (sample Nos. 1–28) of the present invention in which the Ni-containing oxide layer 41 or the metal layer 40 was formed on the seal portion 13*c* of the terminal metal piece 13 causes a smaller increase of the resistance after the impact test compared to the spark plug of Comparative Example (sample No. 29) in which neither Ni-containing oxide layer nor metal layer is formed, which indicates that the bonding strength between the seal portion 13*c* and the conductive glass seal layer 17 is excellent.

EXAMPLE 2

Metal powder and glass powder (having an average particle size of 150 μm) were mixed such that the metal powder content became about 50 wt. %, to thereby prepare conductive glass powder. In the present example, Sn powder, Zn powder, Sb powder, or Ag powder (having an average particle size 20 to 50 μm) was added as a source of an auxiliary metal component in an amount of 0.01 to 50 wt. %. When the amount of the auxiliary metal powder was less than 50 wt. %, Cu powder (average particle size: 30 μm), which served as a balance, was mixed. The material of the glass powder was same as in Example 1. Also, the resister material powder was prepared in the same manner as in Example 1.

Subsequently, samples of the resistor spark plug 100 shown in FIG. 1 were produced by the method shown in FIGS. 3 and 4 (sample Nos. 101 to 120). The second portion 6*b* of the through-hole 6 of the insulator 2 had an inner diameter of 4.0 mm. The conductive glass powder was charged in an amount of 0.15 g in order to form the conductive glass powder layer 26. The resistor material powder was changed in an amount of 0.40 g. The conductive glass powder was again charged in an amount of 0.15 g in order to form the conductive glass powder layer 27. The hot press treatment was performed at a heating temperature of 900° C. and a pressure of 100 kg/cm$^2$.

The terminal metal piece 13 was made of a low carbon steel, and an Ni layer 13*d* having a film thickness of 5 $\mu$m was formed on the surface of the terminal metal piece 13 by electroplating. The seal portion 13*c* was formed into a circular columnar shape having an outer diameter of about 3.5 mm and a length of about 35 mm. The circumferential surface of the seal portion 13*c* was smoothed such that the surface roughness after the formation of the electroplated Ni layer 13*d* became about 6 $\mu$mRa (arithmetical mean deviation of profile). Further, the clearance between the wall surface of the through-hole 6 of the insulator 2 and the peripheral surface of the seal portion 13*c* was set to about 0.2 mm.

For the respective samples of the spark plugs, the bonding strength between the seal portion 13*c* and the conductive glass seal layer 17, as well as degree of sintering was evaluated in the same manner as in Example 1. After the evaluation, the content of the auxiliary metal component (Sn, Zn, Sb, Ag) in the conductive glass seal layer 17 was obtained through ICP analysis. Table 2 shows the results of the evaluation.

TABLE 2

| | Added metal | Addition amount (wt. %) | Evaluation of impact resistance 10 min | 30 min | Degree of sintering | Total |
|---|---|---|---|---|---|---|
| 101 | Sn | 0.1 | B | B | ○ | ○ |
| 102 | Sn | 2 | A | A | ○ | ○ |
| 103 | Sn | 10 | A | B | ○ | ○ |
| 104* | Zn | 0.01 | B | D | ○ | X |
| 105 | Zn | 0.1 | B | B | ○ | ○ |
| 106 | Zn | 1 | A | B | ○ | ○ |
| 107 | Zn | 10 | A | B | ○ | ○ |
| 108* | Zn | 15 | B | B | X | X |
| 109* | Zn | 30 | B | D | X | X |
| 110* | Sb | 0.02 | B | D | ○ | X |
| 111 | Sb | 0.3 | B | B | ○ | ○ |
| 112 | Sb | 5 | A | A | ○ | ○ |
| 113* | Sb | 20 | B | D | X | X |
| 114* | Ag | 0.01 | B | D | ○ | X |
| 115 | Ag | 0.5 | A | B | ○ | ○ |
| 116 | Ag | 2 | A | A | ○ | ○ |
| 117 | Ag | 10 | A | B | ○ | ○ |
| 118* | Ag | 12 | B | B | X | X |
| 119* | Ag | 20 | B | D | X | X |
| 120* | Ag | 50 | B | D | X | X |

Note *outside the scope of the invention

As can be seen from Table 2, the spark plugs of the present invention in which an auxiliary metal component is mixed into the conductive glass seal layer 17 in an amount of 0.1 to 10 wt. % causes a smaller increase of the resistance after the impact test compared to the spark plug of Comparative Example (sample No. 29) in which no auxiliary metal component is mixed into the conductive glass seal layer 17, which indicate that the bonding strength between the seal portion 13*c* and the conductive glass seal layer 17 is excellent. Meanwhile, the spark plugs (sample Nos. 104, 110, and 114) whose auxiliary-metal content is less than 0.1 wt. % causes a relatively large increase of the resistance, and the bonding strength between the seal portion 13*c* and the conductive glass seal layer 17 is insufficient. Further, the spark plugs (sample Nos. 108, 109, 113, 118, 119, and 120) whose auxiliary-metal content exceeds 10 wt. % have the deficiencies of poor degree of sintering and insufficient bonding strength.

Obviously, numerous modifications and variations of the present invention are possible in light of the above teachings. It is therefore to be understood that within the scope of the appended claims, the present invention may be practiced otherwise than as specifically described herein.

What is claimed is:

1. A spark plug comprising:

a metallic shell having a ground electrode;

an insulator disposed within the metallic shell and having an axially extending through-hole;

a center electrode disposed within the through-hole of the insulator;

a terminal metal piece disposed within the through-hole of the insulator; and a conductive coupling layer disposed within the through-hole and located between the center electrode and the terminal metal piece, the conductive coupling layer having a conductive glass seal layer on at least an end facing the terminal metal piece, wherein the terminal metal piece has a surface layer region in contact with the conductive glass seal layer, and the surface layer region is formed of a metal layer made mainly of at least one metal selected from the group consisting of Zn, Sn, Pb, Rh, Pd, Pt, Cu, Au, Sb, and Ag.

2. A spark plug according to claim 1, wherein the metal layer has a thickness of 0.1 $\mu$m or greater.

3. A spark plug according to claim 2, wherein the metal layer has a thickness of 1 $\mu$m or greater.

4. A spark plug according to claim 1, wherein the tip end of the terminal metal piece is in contact with the conductive glass seal layer, while being inserted therein, and has a substantially smooth outer circumferential surface.

5. A spark plug comprising:

a metallic shell having a ground electrode;

an insulator disposed within the metallic shell and having an axially extending through-hole;

a center electrode disposed within the through-hole of the insulator;

a terminal metal piece disposed within the through-hole of the insulator; and a conductive coupling layer disposed within the through-hole and located between the center electrode and the terminal metal piece, the conductive coupling layer having a conductive glass seal layer on at least an end facing the terminal metal piece, wherein the terminal metal piece has a surface layer region in contact with the conductive glass seal layer, and the surface layer region is formed of a conductive or semi-conductive oxide layer having a thickness of 0.1 $\mu$m or greater.

6. A spark plug according to claim 5, wherein the oxide layer is an Ni-containing oxide layer.

7. A spark plug according to claim 6, wherein the oxide layer has a thickness of 1 $\mu$m or greater.

8. A spark plug according to claim 7, wherein the tip end of the terminal metal piece is in contact with the conductive glass seal layer, while being inserted therein, and has a substantially smooth outer circumferential surface.

9. A spark plug according to claim 5, wherein the tip end of the terminal metal piece is in contact with the conductive glass seal layer, while being inserted therein, and has a substantially smooth outer circumferential surface.

10. A spark plug comprising:

a metallic shell having a ground electrode;

an insulator disposed within the metallic shell and having an axially extending through-hole;

a center electrode disposed within the through-hole of the insulator;

a terminal metal piece disposed within the through-hole of the insulator; and a conductive coupling layer disposed within the through-hole and located between the center electrode and the terminal metal piece, the conductive coupling layer having a conductive glass seal layer on at least an end facing the terminal metal piece, the conductive glass seal layer being formed of a mixture of at least one metal and glass, said mixture comprising from 35 to 70 wt. % metal selected from the group consisting of Cu, Fe and mixtures thereof and containing, as an auxiliary metal component, at least one metal selected from Zn, Sb, Sn, Ag, and Ni in an amount of 0.1 to 10 wt. %.

11. A spark plug according to claim 10, wherein the amount of the auxiliary metal component is 2 to 7 wt. %.

12. A spark plug according to claim 10, wherein a surface layer region of the terminal metal piece that comes into contact with the conductive glass seal layer is a metal layer formed of metal containing at lest one metal selected from Zn, Sn, Pb, Rh, Pd, Pt, Cu, Au, Sb, and Ag.

13. A spark plug according to claim 10, wherein a surface layer region of the terminal metal piece that comes into contact with the conductive glass seal layer is a metal layer formed of an Ni alloy containing B or P.

14. A spark plug according to claim 10, wherein a surface layer region of the terminal metal piece that comes into contact with the conductive glass seal layer is a conductive or semi-conductive oxide layer having a thickness of 0.1 $\mu$m or greater.

* * * * *